US005363535A

United States Patent [19]

Rench et al.

[11] Patent Number: 5,363,535

[45] Date of Patent: Nov. 15, 1994

[54] CARPET CLEANING MACHINE WITH CONVERTIBLE-USE FEATURE

[75] Inventors: Geoffrey B. Rench, Racine, Wis.; Stephen Jacobs, Eureka; Frank Jolly, Arcata, both of Calif.

[73] Assignee: Racine Industries, Inc., Racine, Wis.

[21] Appl. No.: 164,815

[22] Filed: Dec. 10, 1993

Related U.S. Application Data

[62] Division of Ser. No. 860,689, Mar. 30, 1992, Pat. No. 5,287,591.

[51] Int. Cl.[5] ..... A47L 5/24

[52] U.S. Cl. ..... 15/344; 15/352

[58] Field of Search ..... 15/344, 347, 352, 353

[56] References Cited

U.S. PATENT DOCUMENTS

| | | | |
|---|---|---|---|
| Re. 32,257 | 10/1986 | Dyson | 15/335 |
| 403,362 | 5/1889 | Morse | 55/392 X |
| 408,787 | 8/1889 | Ash | 55/392 |
| 2,044,827 | 6/1936 | Adams | 15/352 X |
| 2,135,036 | 11/1938 | Karlstrom | 15/347 X |
| 2,167,786 | 8/1939 | Taylor | 55/302 |
| 2,233,167 | 2/1941 | Holm-Hansen | 15/353 |
| 2,323,405 | 7/1943 | Linderoth, Jr. | 55/337 X |
| 2,422,825 | 6/1947 | Davis, Jr. | 55/302 X |
| 2,500,747 | 3/1950 | Ellis | 55/302 X |
| 2,511,598 | 6/1950 | Reeves | 55/302 |
| 2,661,810 | 12/1953 | Heth | 55/301 |
| 2,719,596 | 10/1955 | Kent et al. | 15/347 X |
| 2,731,103 | 1/1956 | Ortega | 15/353 X |
| 2,824,335 | 2/1958 | Moffat | 55/459.1 X |
| 3,008,543 | 11/1961 | Bourdaléet al. | 55/283 |
| 3,046,718 | 7/1962 | Ide et al. | 15/347 X |
| 3,165,774 | 1/1965 | Barba | 15/353 X |
| 3,320,726 | 5/1967 | Black, Jr. | 55/301 X |
| 3,320,727 | 5/1967 | Farley et al. | 55/337 |
| 3,339,348 | 9/1967 | Bratton et al. | 55/301 X |
| 3,685,257 | 8/1972 | Burke | 55/301 X |
| 3,691,735 | 9/1972 | Knierim | 55/391 |
| 3,785,123 | 1/1974 | Leith | 55/301 X |
| 3,802,570 | 4/1974 | Dehne | 55/391 X |
| 3,870,486 | 3/1975 | Eriksson et al. | 55/337 X |
| 3,877,902 | 4/1975 | Eriksson et al. | 55/337 |
| 3,887,344 | 6/1975 | Smith | 55/301 X |
| 3,898,065 | 8/1975 | Coffman | 55/301 |
| 3,925,044 | 12/1975 | Tu et al. | 55/337 |
| 4,257,786 | 3/1981 | Sogo et al. | 55/392 X |
| 4,261,713 | 4/1981 | Bourdois et al. | 55/423 X |
| 4,268,288 | 5/1981 | Coombs | 55/337 |
| 4,353,721 | 10/1982 | Mollstätter | 55/283 |
| 4,373,228 | 2/1983 | Dyson | 15/352 X |
| 4,490,162 | 12/1984 | Davis | 55/213 |
| 4,511,474 | 4/1985 | Krishna et al. | 55/392 X |
| 4,571,772 | 2/1986 | Dyson | 15/335 |
| 4,573,236 | 3/1986 | Dyson | 15/333 |
| 4,593,429 | 6/1986 | Dyson | 15/353 |
| 4,643,748 | 2/1987 | Dyson | 55/338 |
| 4,660,246 | 4/1987 | Duncan et al. | 15/344 X |
| 4,731,101 | 3/1988 | Kanda | 55/323 |
| 4,756,729 | 7/1988 | Brunnmair et al. | 55/391 |
| 4,790,865 | 12/1988 | DeMarco | 55/337 |
| 4,826,512 | 5/1989 | Fuller | 55/283 |
| 4,826,515 | 5/1989 | Dyson | 55/345 |
| 4,853,008 | 8/1989 | Dyson | 55/391 X |
| 5,006,135 | 4/1991 | Friesen | 55/301 X |
| 5,013,342 | 5/1991 | Leussler et al. | 55/337 |
| 5,267,371 | 12/1993 | Soler et al. | 15/353 X |

FOREIGN PATENT DOCUMENTS

| | | | |
|---|---|---|---|
| 0245224 | 11/1987 | European Pat. Off. | 15/347 |
| 1060405 | 4/1954 | France | 15/344 |

OTHER PUBLICATIONS

Clarke Concept 4000 Brochure (8 pages), no date.

Drytech Carpet Dry Cleaning System Brochure, (2 pages), no date.

*Primary Examiner*—Stephen F. Gerrity

*Attorney, Agent, or Firm*—Jansson & Shupe, Ltd.

[57] ABSTRACT

An improved carpet cleaning machine convertible for brush-aided cleaning or vacuuming includes a pair of powered brushes counter-revolving for stroking solvent-dampened carpet cleaning particles through the carpet and along carpet fibers during initial cleaning. A separately-powered pod is detachable from the machine during brush-aided carpet cleaning and attached to a machine-mounted vacuum nozzle for carpet vacuuming to pick up the dirt-laden particles. The pod has first and second media selected to remove particles of differing sizes from air flowing through the pod. During initial carpet cleaning when vacuum is not needed, the pod may be detached and used in another area for hand-vacuuming carpeted stairs and other "small-area" places.

3 Claims, 5 Drawing Sheets

CARPET CLEANING MACHINE WITH CONVERTIBLE-USE FEATURE

RELATED APPLICATION

This application is a division of co-pending application Ser. No. 07/860,689 filed on Mar. 30, 1992, now U.S. Pat. No. 5,287,591.

FIELD OF THE INVENTION

This invention relates generally to cleaning machines and, more particularly, to machines used for carpet cleaning and vacuuming.

BACKGROUND OF THE INVENTION

The three primary approaches used to clean commercial and residential carpets are steam or hot water, foam and dry systems. Dry-type carpet cleaning systems are further divided into two broad categories. One uses a dry or substantially dry powder and the other uses granules slightly moistened with cleaning solvents for dirt removal. The inventive machine has utility for both categories of dry systems but relates primarily to those using granules rather than powder. Such machine also has utility in situations where only carpet vacuuming is performed. That is, its long-bristled brushes are highly effective in removing loose sand and other soil not requiring the application of solvent-bearing material.

Of the dry granular carpet cleaning systems, the best known and most widely used is the HOST® dry extraction system offered by Racine Industries, Inc. of Racine, Wis. The HOST® system applies granules to carpet fibers using a machine as shown in Rench et al. U.S. Pat. Nos. 2,842,788 and 2,961,673. Such machine, sold under the HOST® trademark, is devoid of vacuum capability and has a pair of spaced brushes counter-rotating at relatively low speed (about 350 rpm) to stroke the cleaning granules into, through and across the carpet and its fibers.

The granules are referred to as "dry" and are substantially so even though moistened with cleaning solvents. When stroked as described, these granules "scrub" dirt and soil from such fibers including oily and non-oily soil. The carpet is cleaned by working the HOST® machine across it in different directions. During the cleaning process, granules migrate to the carpet backing adjacent the base of the fiber. A few granules also adhere lightly to the fibers along their lengths. Heretofore, conventional carpet vacuum machines have been used for removing these dirt-ladened granules.

S.C. Johnson Co. of Racine, Wis., sells a vacuum cleaning machine known as the VECTRON TM. Such machine is said to incorporate "dual cyclonic technology" which eliminates the need for a dust bag. The machine can be used for hand vacuuming using a wand. However, one must take the entire machine to the site to do so. The vacuum air stream is not required to flow through collected waste and it is not known whether such machine has a beater bar. An advertising brochure says the machine is "ideal for dry carpet cleaning systems." It is believed that this statement alludes to powder systems since the brochure goes on to say that the machine "does not exhaust powder." It is also believed that such machine is based upon one or both of the following U.S. Pat. Nos. 4,643,748; 4,853,008 (Dyson).

A difficulty attending the use of conventional machines for granule removal is that they perform less than optimally when vacuuming dried-out granules.

Performance of such machines is even less satisfactory when vacuuming damp granules and longer carpet fibers further impair granule cleanup. Repeated passes of conventional machines over carpet surfaces are often used and, even at that, such machines fail to remove substantially all of the spent granules.

Whether damp or dry, such granules (at least those of the HOST® product) do no damage whatever to carpet even though allowed to reside in the carpet for extended periods. But, through carpet usage, granules hidden after vacuuming work their way to the top of the carpet. They are considered by a few to be somewhat unsightly. An approach used by professional cleaners to overcome this is to perform additional vacuuming on one or more successive days—worthwhile even if only to remove newly-deposited dirt—to remove particles which emerge through use.

Yet another difficulty attending the use of conventional machines is that many use only a single filter medium, often a disposable paper bag. To the extent the machine picks up granular material, such bags fill rapidly and work must be suspended during bag disposal and replacement. And many bag/machine configurations draw air through the collected dirt. Vacuum efficiency drops rapidly as the bag fills.

Another disadvantage of conventional machines is that professionals using dry granular carpet cleaning methods are virtually required to invest in two machines, one for brushing the granules into the carpet during non-vacuum cleaning and a vacuum machine for later cleanup. Pairs of machines are cumbersome to move into, around in and out of work sites and represent a significant business investment.

"Dual-mode" (cleaning and vacuum) machines are available for cleaning carpet but they use a dry powder rather than granules. One such machine is made by Clarke-Gravely Corporation of Muskegon, Mich. and sold as the CLARKE CAPTURE carpet cleaning system. Such machine distributes cleaning powder onto the carpet and works the powder into and through the carpet fibers using a round, disk-like scrubber brush, the axis of rotation of which is normal to the carpet surface. Since the machine vacuum system operates to reduce dust rather than recover dirty powder, one is still required to use a separate conventional vacuum machine to remove such powder.

Another type of system used for cleaning carpets with powder is the DRYTECH cleaning machine sold by Sears, Roebuck & Company. The machine has a self-contained vacuum capability and one beater bar with several rows of short-bristled brushes. Such bar is within a shroud which generally conforms to the shape of the bar and by which vacuum is selectively applied. As the brush alone is rotated at high speed, powder is dispensed through two slits, one on either side of the bar between the bar and the shroud. Later, the vacuum is actuated and dry powder (with dirt entrained) is said to be dislodged by the brush and drawn away by vacuum.

A failure of a machine, like the DRYTECH machine, to fully recover powdered cleaner is often not recognized by the site owner/user. This is so since such powdered cleaner is virtually invisible even if distributed on the carpet surface.

Vacuum cleaning machines using cyclone separators are shown in representative U.S. Pat. No. 4,826,515 (Dyson) and U.S. Pat. No. 3,877,902 (Eriksson et al.). Amway Corporation has a Carpet Maintenance System CMS 1000 machine which uses a conventional "beater bar" brush with spirally-arranged brush tufts. Air flow is understood to be first through a cylindrical collection chamber at high velocity, then through a cyclone separator at higher velocity and then through a "HEPA" filter located below a cylindrical collection chamber. The machine is said to have "parallel dual centrifugal separation chambers." It also has a transparent removable waste collection compartment.

Another consideration in machine selection is its flexibility in application. While known machines have certain removable components, those major substructures relating to brush-aided carpet cleaning and to carpet vacuuming are not separable from one another. The utility of such machines is thereby impaired in that they cannot be used to perform different tasks simultaneously. And the resulting added machine weight contributes to operator fatigue.

OBJECTS OF THE INVENTION

It is an object of the invention to overcome some of the problems and shortcomings of the prior art.

Another object of the invention is to provide an improved machine convertible for brush-aided carpet cleaning or for carpet vacuuming.

Still another object of the invention is to provide an improved machine having major substructures which can be used simultaneously for different tasks.

Yet another object of the invention is to provide an improved machine highly effective in removing cleaning granules from carpets, particularly including damp granules.

Another object of the invention is to provide an improved machine permitting easy disposal of collected waste products including dirt-laden cleaning granules. Another object of the invention is to provide an improved machine which helps avoid or entirely eliminates the need to invest in separate cleaning and vacuuming machines.

Still another object of the invention is to provide an improved machine for "deep-down" carpet brushing and vacuuming.

Yet another object of the invention is to provide an improved machine for removing coarse and fine particles from the air stream. How these and other objects are accomplished will become apparent from the following description taken in conjunction with the drawing.

SUMMARY OF THE INVENTION

Briefly stated, the invention includes a machine with revolving brushes used for brush-aided carpet fiber cleaning by the dry method. It also includes a vacuum-producing, particle-filtering pod used to vacuum up granules and other particulates dislodged by the brushes after such cleaning. During initial cleaning in the absence of vacuum, the pod may be detached and removed from the machine for simultaneous use in other clean-up tasks. Such pod removal reduces the weight and bulk of the machine as it is used during brush-aided cleaning.

The improved carpet cleaning machine is based upon the machine shown in U.S. Pat. No. 2,842,788 (Rench et al.). Such machine is configured for use with what is known as a "dry" carpet cleaning method, so named because it is substantially dry and involves no destructive water or steam application to carpet. The leading example of a dry method is the HOST ® method carried out using HOST ® carpet cleaning granules (as well as other HOST ® products), all originating from Racine Industries, Inc. of Racine, Wis. As a profile of size, 99% of the HOST ® granules are 125 microns and larger, 72% are 300 microns and larger and 36% are 425 microns and larger.

The HOST ® granules, small cellulosic particles, are dampened (at the factory) with fiber-cleaning chemicals. In use, the granules are distributed generally evenly on the top of the carpet and then worked in and through the carpet and along the carpet fibers using a special machine supported on a pair of counter-revolving brushes. Dirt is removed from the carpet by being picked up by the granules which are then removed by vacuuming. The improved machine is particularly adept at "digging out" and recovering very damp granular material from carpet fibers, a task for which conventional vacuum cleaners are less than ideally suited. And, of course, it also removes other types of particulate material from carpet.

The machine is intended for use primarily by professional cleaners ("PCs") in the business of cleaning carpets, often in commercial and institutional sites. In such situations, the PC usually cleans large areas of carpet and following such cleaning, vacuums up the dirt-laden granules. Any impediment to the cleaning effort causes a loss in productivity and business profitability. Owning separate brushing and vacuuming machines entails an additional capital expenditure and extra effort in moving machines from place to place. The inventive machine and its detachable, separately-usable pod substantially resolves this problem. And while productivity and profitability are of less concern to do-it-yourself homeowners, they, like the PCs, will appreciate the ease with which the machine is operated and the resulting, greatly reduced operator fatigue.

A preferred machine is configured for carpet brushing (in absence of vacuum) and simultaneous vacuuming of other areas using the detachable pod. And it also enables brush-enhanced carpet vacuuming.

The improved convertible machine includes at least one powered brush (and preferably a pair of brushes) for stroking substantially-dry cleaning particles through a carpet and along the carpet fibers. A separately-powered pod is detachable from the machine during brush-aided carpet cleaning and can be used simultaneously for other clean-up tasks. Mounted in the upper cannister of the pod are first and second media selected to remove particles of differing sizes from the pod air flow path. A vacuum nozzle, machine-mounted between the brushes, is detachably connectable to the pod air flow port for carpet vacuuming.

In a preferred embodiment, the first medium is of a type removing particles by centrifugal action and the second medium is of a type removing particles primarily by mechanical interference with particle movement. The pod is powered by a separate vacuum motor which can be turned on and off independently of the brush-driving motor.

Preferably, a third medium is "downstream" of the motor for removing particulate matter from air expelled from it. The third medium has a soft, flexible structure (e.g., foam) cleanable by washing or, in the alternative, is a relatively rigid automotive-type filter. In another arrangement, the third medium (preferably a mat-like filter) is between the other media and the motor and filters fine particles from air flowing through the pod but before such air enters the motor.

Carpeted floors have several different types of areas, i.e., open areas suitable for machine cleaning and other, small areas (e.g., closet corners, stair treads and the like) which are often cleaned by hand vacuuming. The improved machine addresses both types of cleaning problems. While the machine strokes particles through the carpet for cleaning carpet in one area, the pod may be detached for carpet or other vacuuming in another area. Such pod has a hand-manipulated vacuum wand for the purpose.

The wand is connected to the air flow port during hand vacuuming. During brush-aided carpet vacuuming, the wand is removed and the air flow port connected to the machine.

And that is not all. The machine has other features which make it exceptionally easy and effective to use. For example, the pod includes a bin collecting waste particles removed from the air flow path by the first medium. Dirty, waste particles fall into the bin and out of the air flow path so that particle-entraining air does not pass through the waste as with many conventional vacuum cleaners. The bin has a transparent panel so the user can easily see when it is full. And the bin drawer is detachable from the pod for easy disposal of bin-collected particles.

The pod is equipped with a seal and the bin has an edge adjacent to (i.e., spaced slightly from or lightly in contact therewith) so the bin can be easily removed. During vacuuming, the edge is urged by slight pressure differential to substantially particle-tight engagement with such seal so that particles are prevented from escaping the bin. Of course, the seal may be on the bin and the edge be part of the pod.

The brush-supported machine is incredibly easy to move across carpet-significantly easier than a conventional vacuum machine with wheels. Further details of the improved machine are set forth in the detailed description taken in conjunction with the drawing.

DETAILED DESCRIPTION OF PREFERRED EMBODIMENTS

Figures 1, 2:
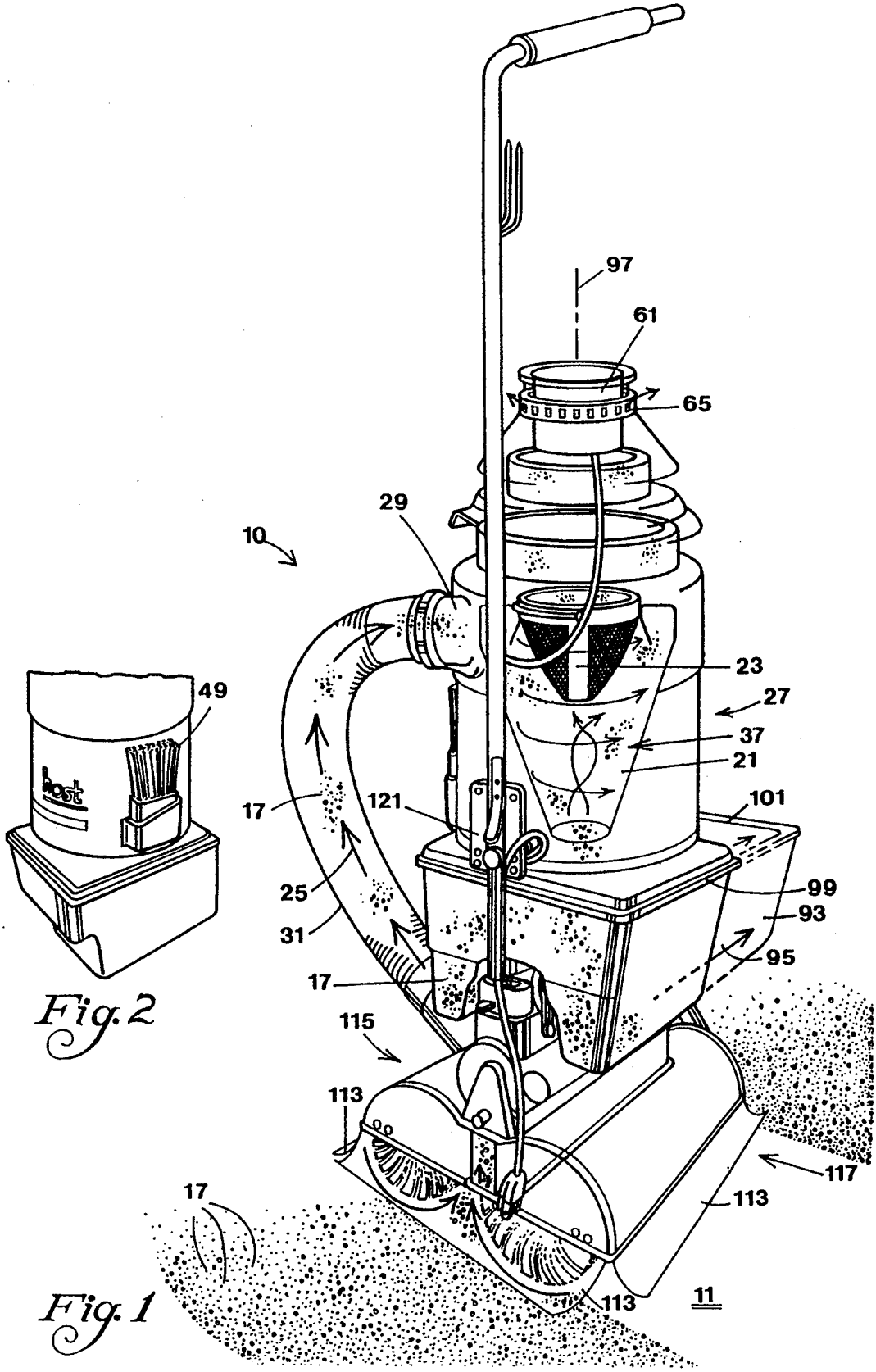
FIG. 1 is an angled elevation perspective view of a composite arrangement of the improved machine with parts shown in phantom.
FIG. 2 is an elevation view of a portion of the machine shown in FIG. 1 taken from a different perspective.
Figure 3:
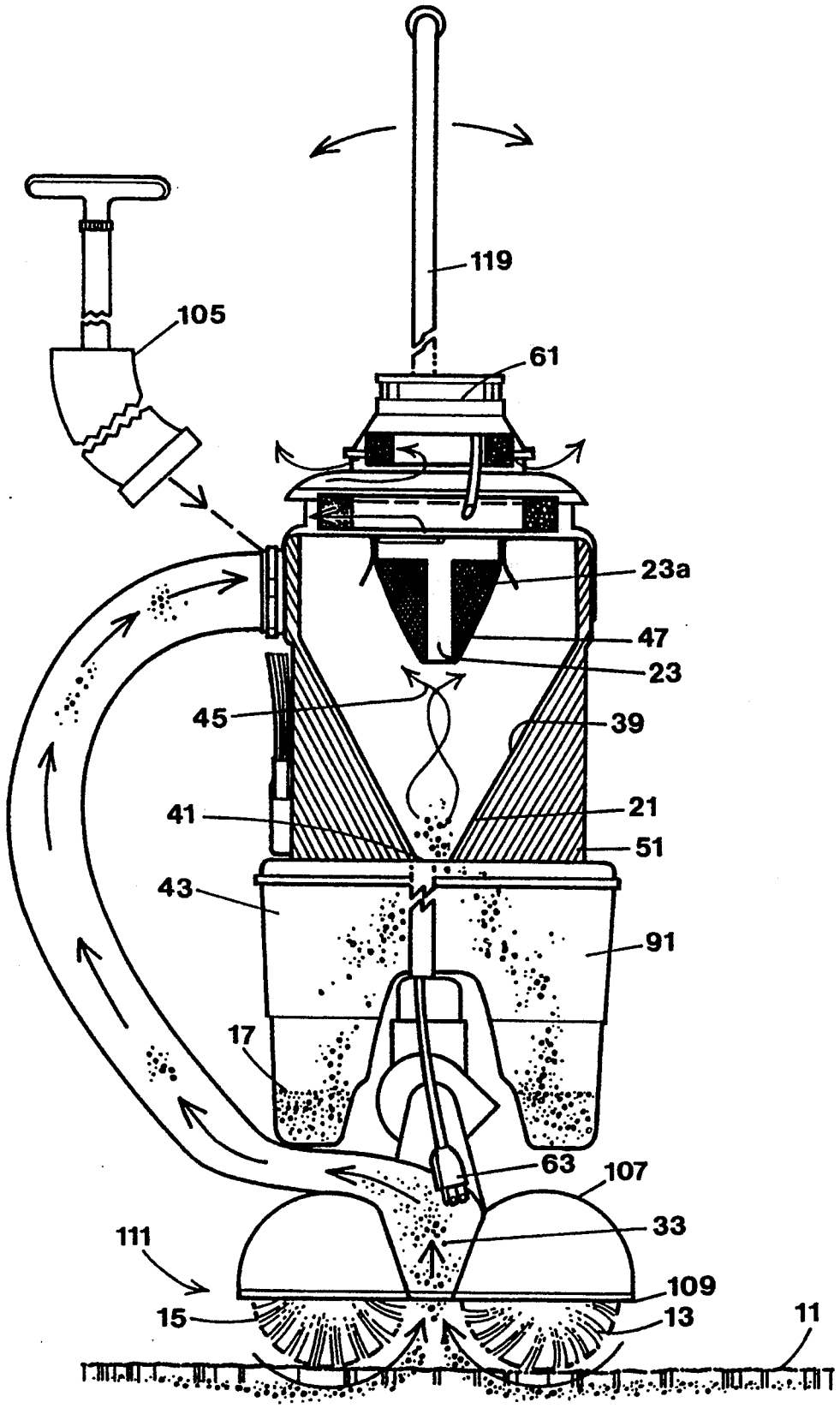
FIG. 3 is a side elevation perspective view of the machine shown in FIG. 1 with parts shown in phantom.

Referring first to FIGS. 1–3, the improved machine 10 cleans carpet 11 in two sequential steps. The basic machine 10 is supported on and uses two counter-revolving brushes 13, 15 to stroke pre-deposited, solvent-moistened particles or granules 17 (preferably HOST® cleaner) into and across carpet fibers as described above. While the improved machine 10 is extremely effective in removing such granules 17, especially including damp granules 17, it has significant utility for removing other types of foreign matter (including powder-like "fines") from carpet 11. As used herein and as used to describe particle size, "coarse" means about 25 microns and larger, "intermediate" means in the range of about 5 to 25 microns and "fine" means below about 5 microns.

The improved machine 10 includes first and second particle-removing media, 21 and 23, respectively. The media 21, 23 are preferably of disparate types selected to remove particles of differing sizes from air 25 flowing through the pod 27. The first medium 21 preferably is of a type which removes particles 17 by centrifugal action. Such type is exemplified by a cone-shaped cyclone separator **21*a***. No doubt carpet owners have experienced that carpets can have embedded therein foreign objects, caked mud, dust and the like of sizes ranging from coarse to fine.

The separator **21*a* has a tangential air inlet 29 connected by a detachable hose 31 to a vacuum nozzle 33 positioned between the brushes 13, 15. Dirt-laden particles 17 are carried along the hose 31 by a high velocity air stream directed to an air-guiding channel 35 at the interior top (larger diameter) portion of the separator 21*a*. The channel 35 guides air toward and along a generally downward, vortex-like or vortical, spiral path 37. The channel 35 helps prevent such air from "short-circuiting" and flowing directly to and through the second medium 23. As air laden with dirty particles 17 increases in velocity as it flows along the vortical path 37, heavier particles 17 are "thrown" to the wall 39 of the separator 21*a* and fall through the opening 41 into the waste collection bin 43**.

It has been found that the cyclone separator **21*a* removes damp or wet HOST® granules and particles 17 down to about 3 microns in size. On the other hand, if the HOST® granules and particles 17 are dry, the separator 21*a* removes those of about 15 microns and larger. And, of course, the degree to which particles 17 sized between 3 microns and 15 microns are removed depends upon the relative dampness of such particles 17** which may have come in contact with HOST® granules.

After passing along the vortical path 37, "rolling" turbulent air (usually with some particles still entrained) follows an irregular path 45 generally upward and impinges on and passes through the second medium 23. The arrows representing the spiral path 37 have been omitted from FIG. 3 to better show the path 45. Depending upon their size and dampness, particles 17 entrained in the upward-moving air stream will be trapped by the second medium. Preferably, the separator **21*a* and air velocity are selected to remove dry particles 17 about 15 microns and larger and the second medium 23 is selected to remove such particles 17 of about 5 microns and larger. However, it has been discovered that when the particles 17 are damp, those somewhat smaller than 5 microns tend to adhere to the second medium 23. To held understand particle size, a rough rule of thumb is that a 10 micron particle 17** is about the smallest that can be seen by the unaided human eye.

The second medium 23 is of a type which removes particles 17 primarily by mechanical interference with particle movement. Pleated paper or cloth filter cartridges typify such a medium 23 as does a fine-mesh, conical, metal screen filter **23*a*. The latter is preferred in that it is relatively rigid, removable for manual cleaning and is of the more durable, extended life type of medium. A metal mesh re-usable coffee filter 23*a* made by Krups has been found to be highly satisfactory. As shown in FIG. 2, lift-out cleaning of the filter 23*a* is with a small broom 49 stowed on the machine 10**.

The media, e.g., cyclone separator 21*a* and conical screen filter 23*a* are generally conformably shaped to one another and have surfaces (like wall 39 and surface 47) spaced generally equidistant from one another along a length "L". Although the second medium 23 removes particles 17 from the air stream primarily by mechanical interference, it has been found that some particles 17 are removed by cyclonic action. Particles 17 removed in that way tend to collect inside the second medium 23, i.e., on the side opposite surface 47 on which air impinges for purging.

As shown in FIGS. 1 and 2, the media 21, 23 are mounted and housed in a generally-cylindrical cannister 51 atop the bin 43. In "working" position, the top edges 53, 55 of the media 21, 23, respectively, are generally coplanar. And the upper rim 57 of the medium 23 and interior surface 59 of the channel 35 are selected to have generally corresponding diameters. In that way, the second medium 23 can "nest" in and seal against the first medium 21.

An electrically-powered, vacuum-creating blower 61 (with a separate electrical plug 63) is atop the pod 27 and of a type drawing air in through the bottom of the blower 61 and expelling it through radial ports 65. Such blower 61 thereby provides the high velocity air stream starting at the vacuum nozzle 33 and ending with air expulsion from the blower 61.

Figure 4:
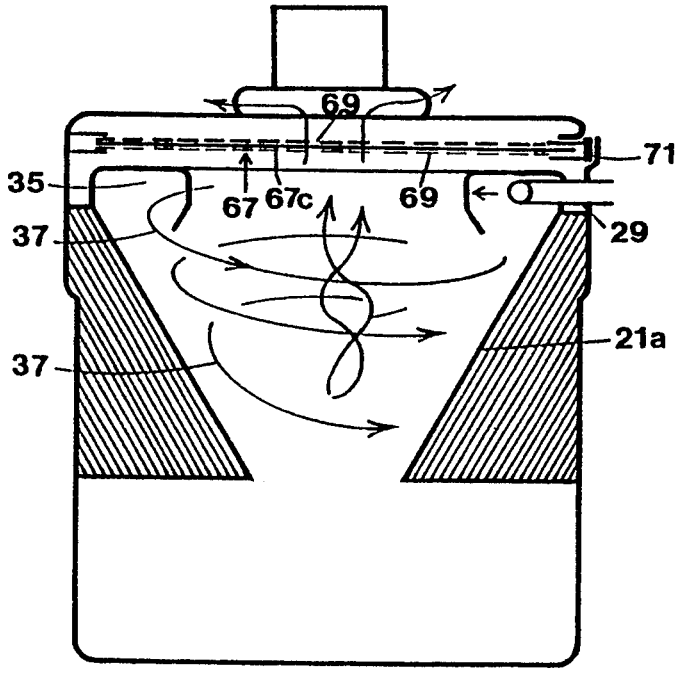
FIGS. 4 through 8 are simplified cross-sectional elevation views showing various arrangements of filter media.

Referring additionally to FIGS. 4–8, for some applications, the machine 10 also includes a third particle-removing medium 67 to remove very fine particulate matter from air expelled from the machine. Like the second medium 23, the third medium 67 is of a type removing particles by mechanical interference with particle movement. One type of preferred third medium 67 is an open cell foam filter 67a having a soft, flexible structure. It removes fine, dust-like particles 17 from the air stream before the air is expelled into the room or space in which the machine 10 is working. A soft, foam-type third medium 67 can be readily washed as necessary to remove any dust accumulated thereon. Another type of third medium 67 is a relatively rigid automotive-type filter 67*b*. The channel 35 as depicted in FIG. 4 and the inlet 29 as depicted in FIG. 1 characterize actual practice.

Figure 6:
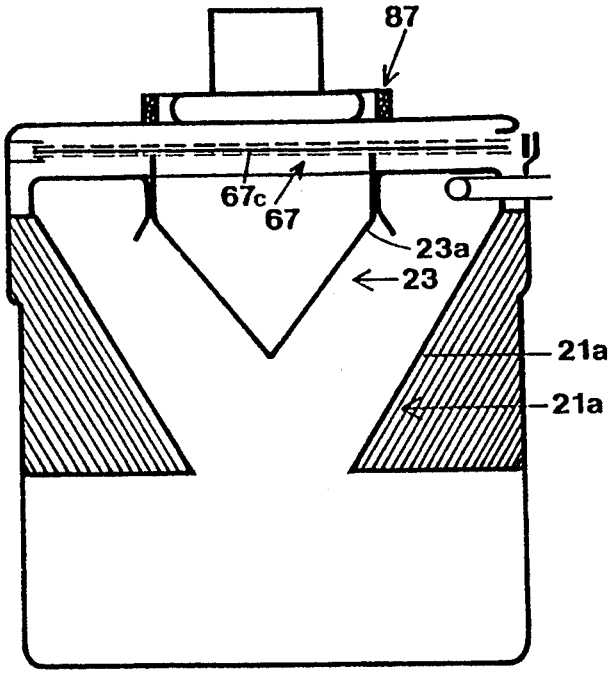
Figure 8:
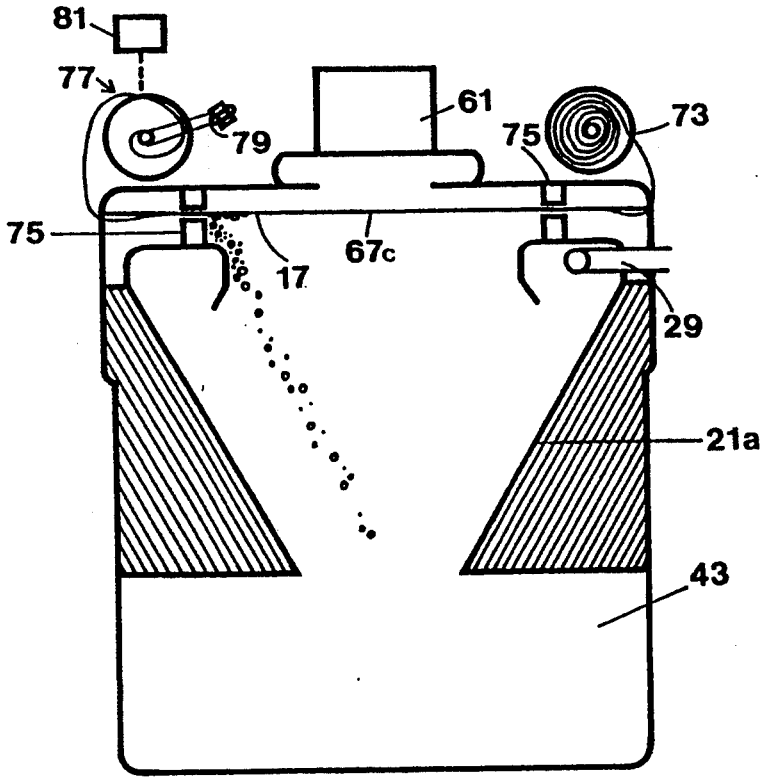

Yet another type of third medium 67 is a generally flat filter mat 67*c* as shown in FIGS. 4 and 6. Such mat 67*c* is in sheet form interposed between coarse wire mesh retainers 69, all in a slide-out tray 71 for easy mat removal and replacement. Or, as shown in FIG. 8, it is ribbon-like and fed from a dispenser 73. Upper and lower perimeter seals 75 prevent air leakage around the mat 67*c*. And as filter mat 67*c* is advanced, the lower seal 75 acts as a scraper and removes quantities of caked particles 17. Retained particles 17 are simply rolled up within the dirty mat 67*c*.

The machine 10 may include a manual or automatic mat-advancing mechanism 77 whereby dirt-laden filter mat 67*c* is replaced by clean filter mat 67*c*. In FIG. 8, the mechanism 77 is manually operated by a crank 79. Or the mechanism 77 may be driven by an electric motor 81.

In one arrangement, the mechanism 77 monitors a blower motor characteristic, e.g., speed or current. When the mat 67*c* is clogged at least to some degree, the blower 61 partially cavitates and its speed increases. Simultaneously, motor current decreases because of the reduced load. The mechanism 77 replaces mat 67*c* when the characteristic is equal to a predetermined value "signalling" that mat clogging or "loading" has reached an undesirable level. In another arrangement, the mechanism 77 monitors a mat characteristic, e.g, pressure drop across it. Such pressure drop is sometimes referred to as "pressure differential." With increasing mat clogging, the pressure drop or differential across it increases. Mat 67*c* is replaced when such pressure drop increases is equal to a predetermined value.

Figure 5:
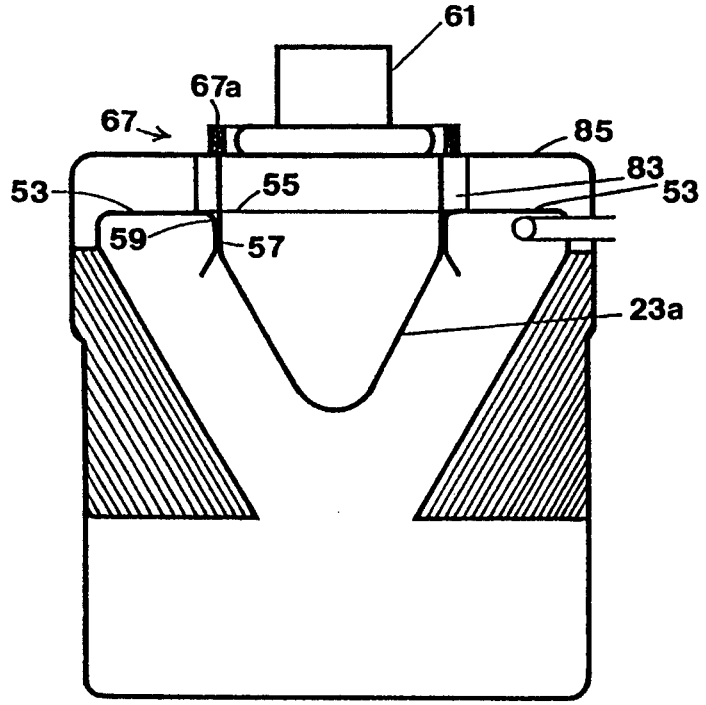
Figure 7:
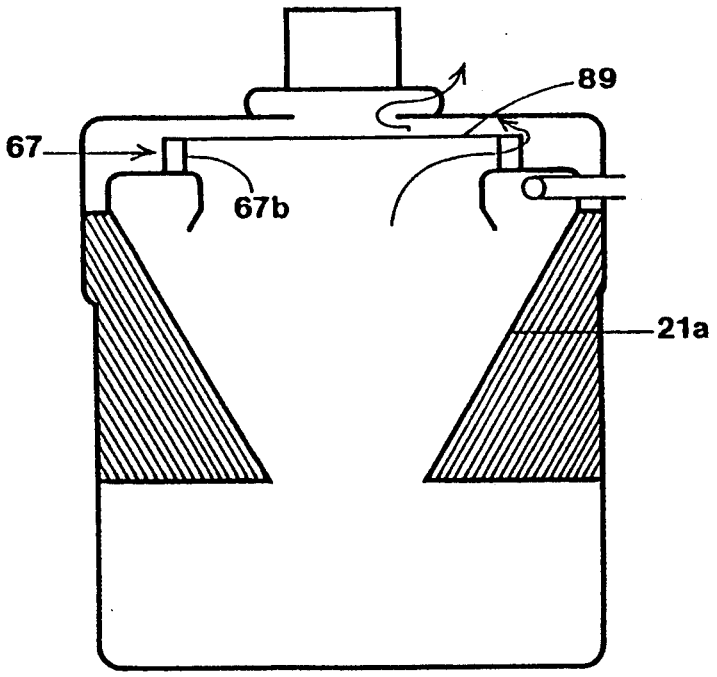

It is to be appreciated that several combinations of particle-removing media are possible. For example, the cone shaped medium 23*a* can be omitted and the separator 21*a* and mat 67*c* used as shown in FIG. 4. In the arrangement of FIG. 5, the cone shaped medium 23*a* is used with an open-cell foam filter 67*a* or such filter 67*a* is replaced with an automotive-type rigid filter 67*b*. A seal ring 83 fits between the top edge 53 of the separator 21*a* and a cover 85 to prevent air leakage. FIG. 6 shows a "four media" configuration including a cyclone separator 21*a* as the first medium 21, a conical metal-screen filter 23*a* as the second medium 23, a filter mat 67*c* as the third medium 67 and a foam filter 67*a* or an automotive-type filter 67*b* as the fourth medium 87. FIG. 7 shows an arrangement using a cyclone separator 21*a* with an automotive-type filter 67*b* atop it. Air flow is "inside out" through the filter 67*b* which is capped with an imperforate cover 89.

As explained above, carpet cleaning using granules 17 or powder-like cleaners is performed in a sequence of brush-aided carpet cleaning followed by brush-enhanced carpet vacuuming. To that end, the particle-removing media 21, 23, 67, 87 (to the extent such media are used) are mounted with a pod 27 removable from the machine 10 during carpet brushing thereby reducing machine weight and bulk. The pod 27 includes a bin 43 collecting waste particles 17 removed from the air flow path 37 by the first medium 21 as well as those purged from the second medium 23. Dirty waste particles 17 fall into the bin 43 and out of the air flow path 37 so that particle-entraining air does not pass through the waste particles 17 as with many conventional vacuum cleaners. The bin 43 has a transparent panel 91 so the user can easily see when it is full. And the bin drawer 93 is detachable from the pod remainder for disposing of particles 17 collected therein. Detachment is by sliding the drawer 93 along an axis 95 normal to the axis 97 of the pod 27.

The pod 27 is equipped with a seal 99 and the drawer 93 has an edge 101 adjacent to (i.e., spaced slightly from or lightly in contact therewith) so the drawer 93 can be easily removed. During vacuuming, the edge 101 is urged by slight pressure differential to substantially particle-tight engagement with such seal 99 so that particles 17 are prevented from escaping the bin 43. Of course, as an alternative arrangement, the seal 99 may be on the drawer 93 and the edge 101 be part of the pod 27.

The machine 10 is entirely supported on a pair of long-bristled, counter-revolving brushes 13, 15. The vacuum nozzle 33 is between the brushes 13, 15 for removing dirt-laden particles 17 from carpet 11 following brush-aided carpet cleaning operations. The nozzle 33 is detachably connected to the pod 27 by the hose 31 to facilitate pod removal. The hose connection port 103 on the pod 27 is also used (as an alternative to machine vacuuming) to attach a hand-manipulated vacuum wand 105 to the pod 27. Such wand 105 can be used to clean "small-area" carpet, e.g., stair treads and the like, which have an insufficient surface area to readily support the machine 10.

Referring particularly to FIGS. 1 and 3, the brushes 13, 15 "stroke" carpet cleaning granules 17 through the carpet 11 and along the carpet fibers for cleaning. A brush shroud 107 prevents particles 17 from being randomly thrown about, especially upward toward the machine operator. Such shroud 107 terminates in a lower edge or perimeter 109 which is spaced somewhat from the carpet 11. During carpet cleaning, the space 111 permits granules 17 to "fly out" from beneath the machine 10 and be re-distributed on the carpet 11. However, more efficient granule retrieval results when a movable skirt 113 is provided for selectively closing at least a portion of that space 111—and preferably substantially the entirety of the space 111 around the perimeter 109 of the shroud 107—during vacuuming.

The machine has front and rear sections 115, 117, respectively and includes a handle 119 mounted for "wide-arc" pivoting movement. The machine operator can thereby position the handle 119 so that carpet 11 proximate to a wall may be cleaned with either section 115, 117. And the handle 119 includes a latch 121 locking the handle 119 in a position permitting application of tipping force to the machine 10. Slight machine tipping fore or aft causes the brush 13, 15 at the rear or front section 117, 115, respectively, to "mesh into" the carpet 11, thereby provide a degree of self-propulsion and reduce the already-low effort required for machine maneuvering.

And it is to be appreciated that the pod 27 is detachable from the machine 10 for performing separate vacuuming tasks while the machine 10 is used for brushing granules. The pod 27 includes the upper cannister 51, a hand-manipulated vacuum wand 105 and a motor-driven vacuum blower 61 mounted atop the cannister 51. It also includes cannister-mounted first and second particle-removing media 21, 23 of disparate types. Like those of the machine 10 described above, such media 21, 23 are selected to remove particles of differing sizes from air urged through the wand 105 and the cannister 51 by the blower 61. The pod 27 can simply be demounted and detached from the machine 10 and is self-contained for hand vacuuming of carpet. And of course, the pod 27 may also include a third particle-removing medium 67 for filtering fine particles 17 from the air stream.

While the principles of the invention have been described by way of examples, the invention is not intended to be limited by such examples. Other arrangements contemplated by the invention are possible.

We claim:

1. A hand-carried pod for vacuum-cleaning carpet and including:

a canister having an air flow path therethrough;

canister-mounted particle-removing media selected to remove particles of differing sizes from the flow path;

a particle-collecting bin removably mounted at the bottom of the canister for receiving particles removed from the flow path;

and wherein:

the bin has a pair of downwardly-depending portions;

each portion has a surface substantially coplanar with the surface of the other portion, whereby such surfaces may support the pod upright on a floor.

2. The pod of claim 1 wherein:

the downwardly-depending portions have an open space therebetween, whereby the portions and the space generally adapt the pod for mounting on a carpet-brushing machine.

3. The pod of claim 2 including a broom mounted thereon for brushing particles from the media.

* * * * *